US010865974B2

(12) United States Patent
Duan et al.

(10) Patent No.: US 10,865,974 B2
(45) Date of Patent: Dec. 15, 2020

(54) SOLID STATE LIGHTING LAMP

(71) Applicant: SIGNIFY HOLDING B.V., Eindhoven (NL)

(72) Inventors: Xiaoqing Duan, Shanghai (CN); Zhigang Pei, Shanghai (CN); Linggen Mo, Shanghai (CN)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/618,888

(22) PCT Filed: Jun. 1, 2018

(86) PCT No.: PCT/EP2018/064395

§ 371 (c)(1),
(2) Date: Dec. 3, 2019

(87) PCT Pub. No.: WO2018/224393

PCT Pub. Date: Dec. 13, 2018

(65) Prior Publication Data

US 2020/0088396 A1 Mar. 19, 2020

(30) Foreign Application Priority Data

Jun. 8, 2017 (WO) ..... PCT/CN2017/087581
Aug. 7, 2017 (EP) ..... 17185068

(51) Int. Cl.
*F21V 21/00* (2006.01)
*F21V 29/71* (2015.01)
(Continued)

(52) U.S. Cl.
CPC ..... *F21V 29/71* (2015.01); *F21K 9/232* (2016.08); *F21K 9/237* (2016.08); *F21V 17/104* (2013.01);
(Continued)

(58) Field of Classification Search
CPC ..... F21V 29/71; F21V 29/83; F21V 17/104; F21V 3/04; F21K 9/232; F21K 9/237; F21Y 2013/10; F21Y 2107/50
(Continued)

(56) References Cited

U.S. PATENT DOCUMENTS 7,815,338 B2 * 10/2010 Siemiet ..... F21V 29/74 362/218
10,451,263 B2 * 10/2019 Lan ..... F21V 17/12
(Continued)

FOREIGN PATENT DOCUMENTS

CN 202008011 U 10/2011
CN 203431609 U 2/2014
(Continued)

*Primary Examiner* — Laura K Tso
(74) *Attorney, Agent, or Firm* — Daniel J. Piotrowski

(57) ABSTRACT

A solid state lighting lamp (10) is disclosed comprising a plurality of heatsink modules (40) each extending in alignment with a central axis (15) of the lamp, each heatsink module carrying a plurality of solid state lighting elements (50); and a body (20) extending in alignment with said central axis and delimiting an inner volume of the lamp, wherein the heatsink modules are affixed to said body. The body is the optical housing, i.e. the light exit window of the lamp.

6 Claims, 9 Drawing Sheets

(51) Int. Cl.

| | |
|---|---|
| ***F21V 29/83*** | (2015.01) |
| ***F21K 9/232*** | (2016.01) |
| ***F21K 9/237*** | (2016.01) |
| ***F21V 17/10*** | (2006.01) |
| *F21Y 103/10* | (2016.01) |
| *F21Y 115/10* | (2016.01) |
| *F21Y 107/50* | (2016.01) |
| *F21V 3/04* | (2018.01) |

(52) U.S. Cl.
CPC ..... *F21V 29/83* (2015.01); *F21V 3/04* (2013.01); *F21Y 2103/10* (2016.08); *F21Y 2107/50* (2016.08); *F21Y 2115/10* (2016.08)

(58) Field of Classification Search
USPC ..... 362/249.02, 218, 223, 225, 345, 547
See application file for complete search history.

(56) References Cited

U.S. PATENT DOCUMENTS

| | | | | |
|---|---|---|---|---|
| 10,527,274 | B2 * | 1/2020 | Bosl | F21V 29/506 |
| 10,544,906 | B1 * | 1/2020 | Openiano | F21V 19/003 |
| 2005/0168985 | A1 | 8/2005 | Chen | |
| 2007/0230184 | A1 | 10/2007 | Shuy | |
| 2009/0116233 | A1 | 5/2009 | Zheng et al. | |
| 2010/0019689 | A1 | 1/2010 | Shan | |
| 2011/0090686 | A1 | 4/2011 | Pickard | |
| 2011/0156584 | A1 | 6/2011 | Kim | |
| 2015/0048759 | A1 | 2/2015 | Jo | |
| 2016/0341414 | A1 | 11/2016 | Jiang | |

FOREIGN PATENT DOCUMENTS

| | | | |
|---|---|---|---|
| EP | 3208519 | A1 | 8/2017 |
| WO | 2016058285 | A1 | 4/2016 |
| WO | 2016098464 | A1 | 6/2016 |

* cited by examiner

10

40

10

10

SOLID STATE LIGHTING LAMP

CROSS-REFERENCE TO PRIOR APPLICATIONS

This application is the U.S. National Phase application under 35 U.S.C. § 371 of International Application No. PCT/EP2018/064395, filed on Jun. 1, 2018, which claims the benefit of International Application No. PCT/CN2017/087581, filed on Jun. 8, 2017 and European Patent Application No. 17185068.8, filed on Aug. 7, 2017. These applications are hereby incorporated by reference herein.

FIELD OF THE INVENTION

The present invention relates to a solid state lighting lamp comprising a plurality of heatsink modules each extending in alignment with a central axis of the lamp, each optical module carrying a plurality of solid state lighting elements.

BACKGROUND OF THE INVENTION

Modern society is witnessing a shift towards solid state lighting (SSL) applications such as LED applications. Such applications have improved longevity, e.g. through improved robustness against accidental impacts, and superior energy consumption characteristics compared to traditional light sources such as incandescent and halogen light sources. One such an application domain is outdoor lighting, where traditionally HPS and high-intensity discharge (HIS) lamps have been used to illuminate outdoor areas, e.g. public outdoor areas such as streets, squares, motorways and so on. Another type of lamp that is commonly replaced by SSL equivalents is a compact fluorescent lamp (CFL). Such SSL lamps for replacing HPS lamps, HIS lamps or CFLs have common that they exhibit an elongated body centred on a central axis, which body often is cylindrical or polygonal in nature.

An example of such an SSL lamp is disclosed in Chinese utility model CN 202008011 U, which discloses a LED lamp comprising a plurality of H-shaped heat sink modules interconnected in a tongue and groove fashion to form a closed body, wherein each heat sink module carries a strip of LED elements on an outer surface. Such a lamp has the advantage that it can be assembled in a straightforward manner. However, in order to obtain the required structural integrity of the closed body, each heat sink module is relatively thick, which increases weight of the lamp and adds to its cost. This is problematic, as the market for SSL lamps is notoriously competitive, which depresses profit margins. What is more, with demand for increasing luminous power to be produced by such lamps, the thermal requirements become more challenging, which leads to the weight of the lamp increasing due to larger (heavier) heat sinks, to such an extent that it becomes challenging to keep the weight of the lamp below its maximum allowed weight for health and safety considerations. Consequently, there is a continuing need to reduce the weight of such SSL lamps.

SUMMARY OF THE INVENTION

The present invention seeks to provide a robust SSL lamp in an alternative, e.g. a more cost-effective, arrangement.

According to an aspect, there is provided a solid state lighting lamp comprising a plurality of heatsink modules each extending in alignment with a central axis of the lamp, each heatsink module having an outward facing surface and an inner surface opposite to the outward facing surface, and carrying a plurality of solid state lighting elements on the outward facing surface; and a body extending in alignment with said central axis and delimiting an inner volume of the lamp, wherein the heatsink modules are affixed to said body.

The present invention is based on the insight that by securing the heatsink modules to a separate body, the structural integrity of the lamp may be provided to a large extent by the separate body such that the heatsink modules may be made more lightweight, e.g. thinner, thereby reducing the overall weight of the solid state lighting lamp because the separate body may be made of a lightweight material such as a polymer material due to the fact that the separate body does not need to provide a significant contribution to the thermal dissipation capacity of the heatsink modules.

Preferably, each heatsink module is affixed to said body by at least one tongue and groove coupling. This facilitates easy assembly of the solid state lighting lamp whilst maintaining structural integrity, which therefore makes this type of coupling advantageous in terms of assembly efficiency and cost.

In one particular embodiment, the body defines a light exit window (also referred to as optical housing) of the solid state lighting lamp, and each heatsink module is affixed to an inner surface of said body. This for example has the advantage that the heatsink modules do not have to be affixed to each other, which may be used to reduce the weight of the lamp and allows for a greater flexibility in the optical performance of the solid state lighting lamp. This also assists in achieving improved thermal dissipation characteristics, for example where an air flow through the solid state lighting lamp along its central axis can be facilitated, as the spacing between adjacent heatsink modules allows for more effective heat transfer between the heatsink modules and the air flow. Preferably, the air flow runs over the solid state lighting elements on the inner surface of the heatsink module and over the inner surface of the heatsink modules Such a body, i.e. a light exit window or optical housing, may be cylindrical to achieve a particularly aesthetically pleasing solid state lighting lamp.

Preferably, each heat sink module is made of a bent sheet metal. Such heat sink modules can be made cost-effectively and to a low weight due to the relative thinness of the sheet metal, thereby aiding to reduce the overall weight of the solid state lighting lamp.

The solid state lighting lamp may further comprise a further body within the body and a driver for said solid state lighting elements housed within said further body. Such a further body may be made of a lightweight material such as a polymer material and may be used to secure the driver within the solid state lighting lamp.

In another particular embodiment, the body is arranged inside the plurality of heatsink modules and the inner volume houses a driver of the solid state lighting elements. In this embodiment, the inward facing surfaces of the heatsink modules may be attached to such a body, which again supports the heatsink modules such that the heatsink modules may be made of a relatively thin material to reduce the overall weight of the solid state lighting lamp.

The driver may be secured within said body by at least one tongue and groove coupling with the body. Consequently, the driver can be secured within the body in an easy and straightforward manner, thereby reducing manufacturing complexity and the overall cost of the solid state lighting lamp.

In an embodiment, an outwardly facing portion of each heatsink module comprises a recess in which the solid state lighting elements are mounted, said recess being covered by an optical element. This has the advantage that a separate light exit window or optical housing of the solid state lighting lamp may be omitted as for each heatsink module the solid state lighting elements are covered by a separate optical element, thereby reducing the overall weight of the solid state lighting lamp.

Each recess may comprise a mounting surface on which the solid state lighting elements are mounted, and each heatsink module may further comprise an outer surface facing said body and a support rib extending between the mounting surface and the outer surface to further strengthen the heatsink module and to increase its surface area to improve the thermal dissipation characteristics of the heating modules.

Each heatsink module preferably is an extruded aluminium heatsink module as extrusion can be used to manufacture particularly thin heating modules, which is beneficial to reducing the overall weight of the solid state lighting lamp.

The solid state lighting elements may be arranged on the respective heatsink modules in any suitable manner. In an example embodiment, each plurality of solid state lighting elements is arranged as at least one linear array of solid state lighting elements aligned with said central axis in order to achieve a substantially homogeneous luminous distribution along the central axis of the solid state lighting lamp.

The solid state lighting lamp may further comprise a base including an electrical connector and a cap opposite said base, wherein the body and the heatsink modules extend between the base and the cap. Preferably, the cap comprises a plurality of air vents such that air can flow through the solid state lighting lamp to aid heat transfer between the heatsink modules and the air within the solid state lighting lamp such that the temperature of the solid state lighting elements can be better controlled.

The solid state lighting lamp may be a HPS or CFL replacement lamp although it should be understood that embodiments of the present invention are not limited to such replacement lamps; the solid state lighting lamp may be used to replace any suitable type of incandescent or fluorescent lamp, or any other type of lamp.

BRIEF DESCRIPTION OF THE DRAWINGS

Embodiments of the invention are described in more detail and by way of non-limiting examples with reference to the accompanying drawings, wherein.

DETAILED DESCRIPTION OF THE EMBODIMENTS

Figure 1:
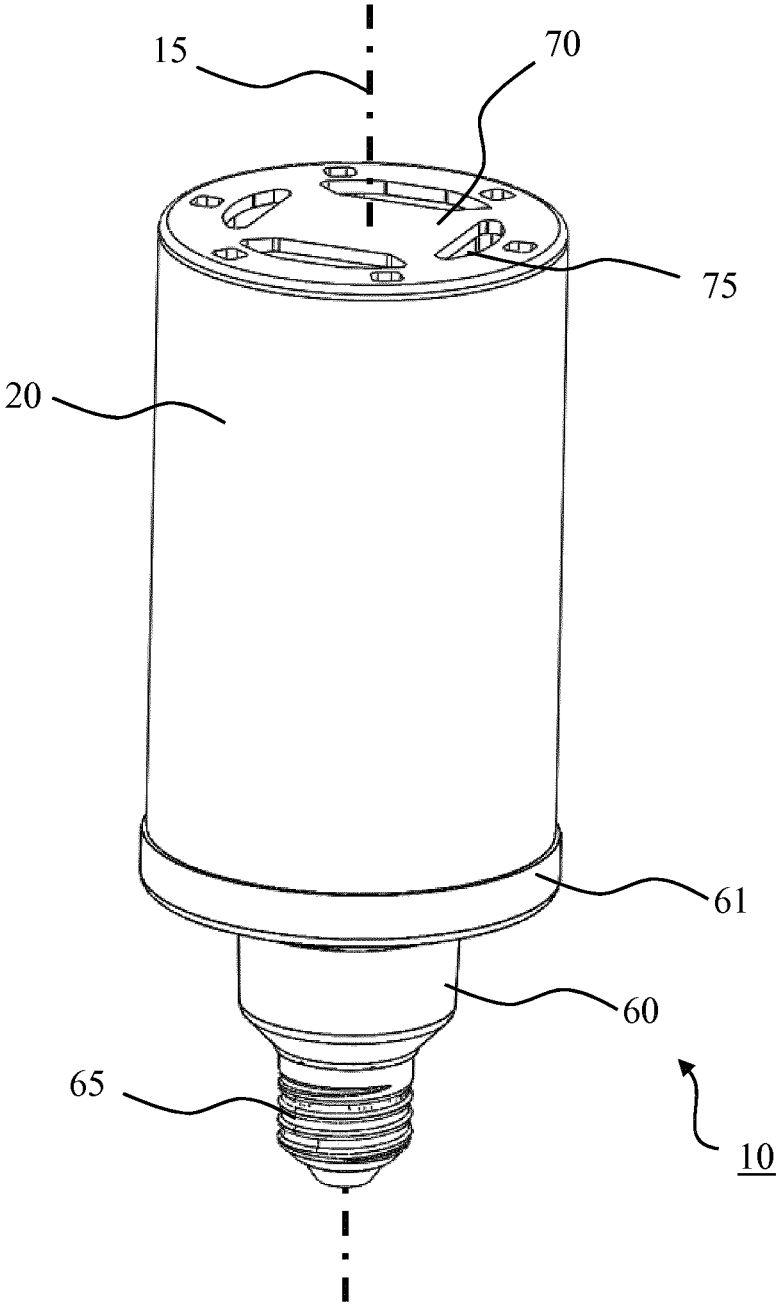
FIG. 1 schematically depicts a solid state lighting lamp according to an embodiment of the present invention.

It should be understood that the Figures are merely schematic and are not drawn to scale. It should also be understood that the same reference numerals are used throughout the Figures to indicate the same or similar parts.

Figure 2:
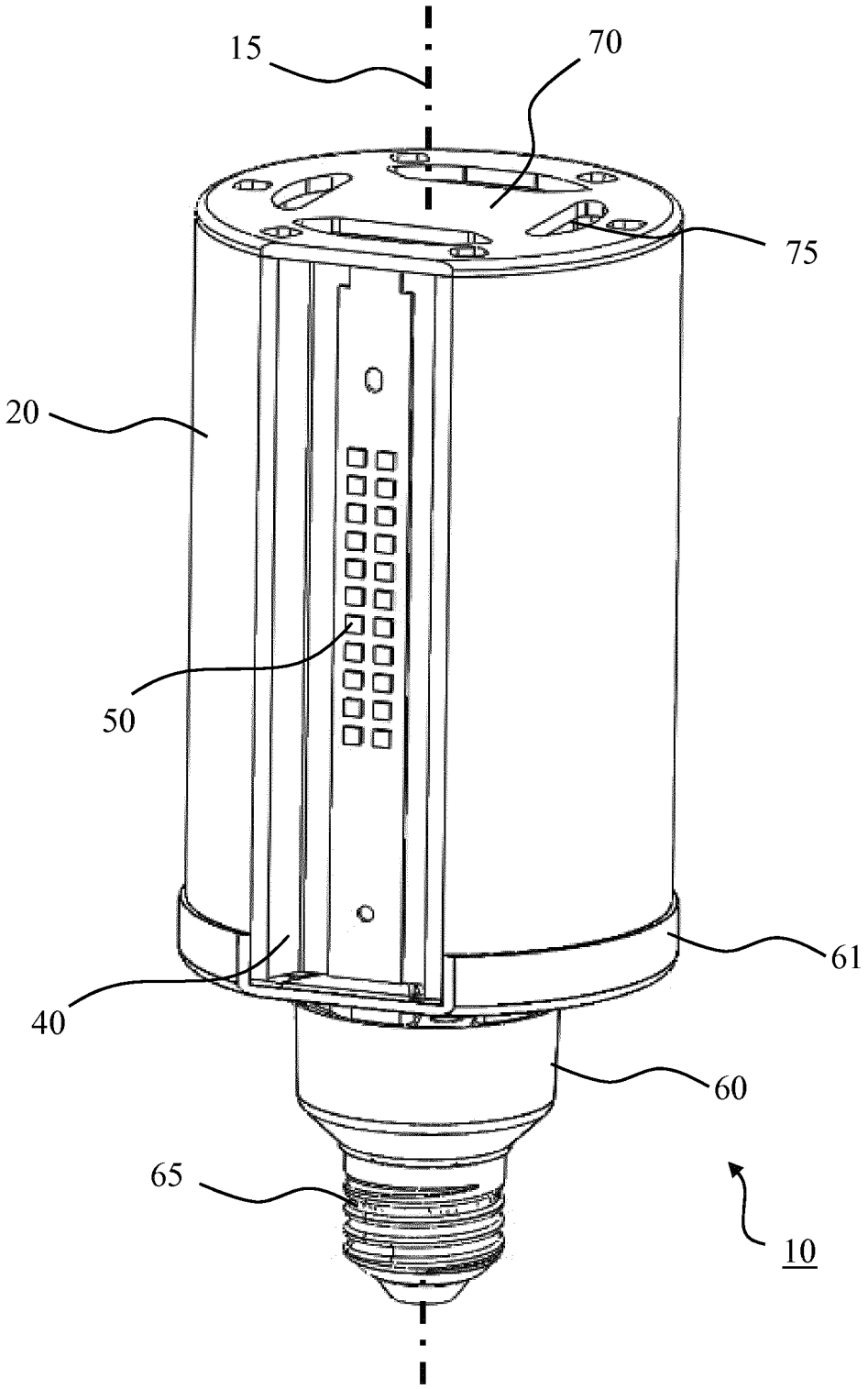
FIG. 2 schematically depicts the solid state lighting lamp of FIG. 1 in which a section of the lamp has been cut out for clarity purposes.
Figure 3:
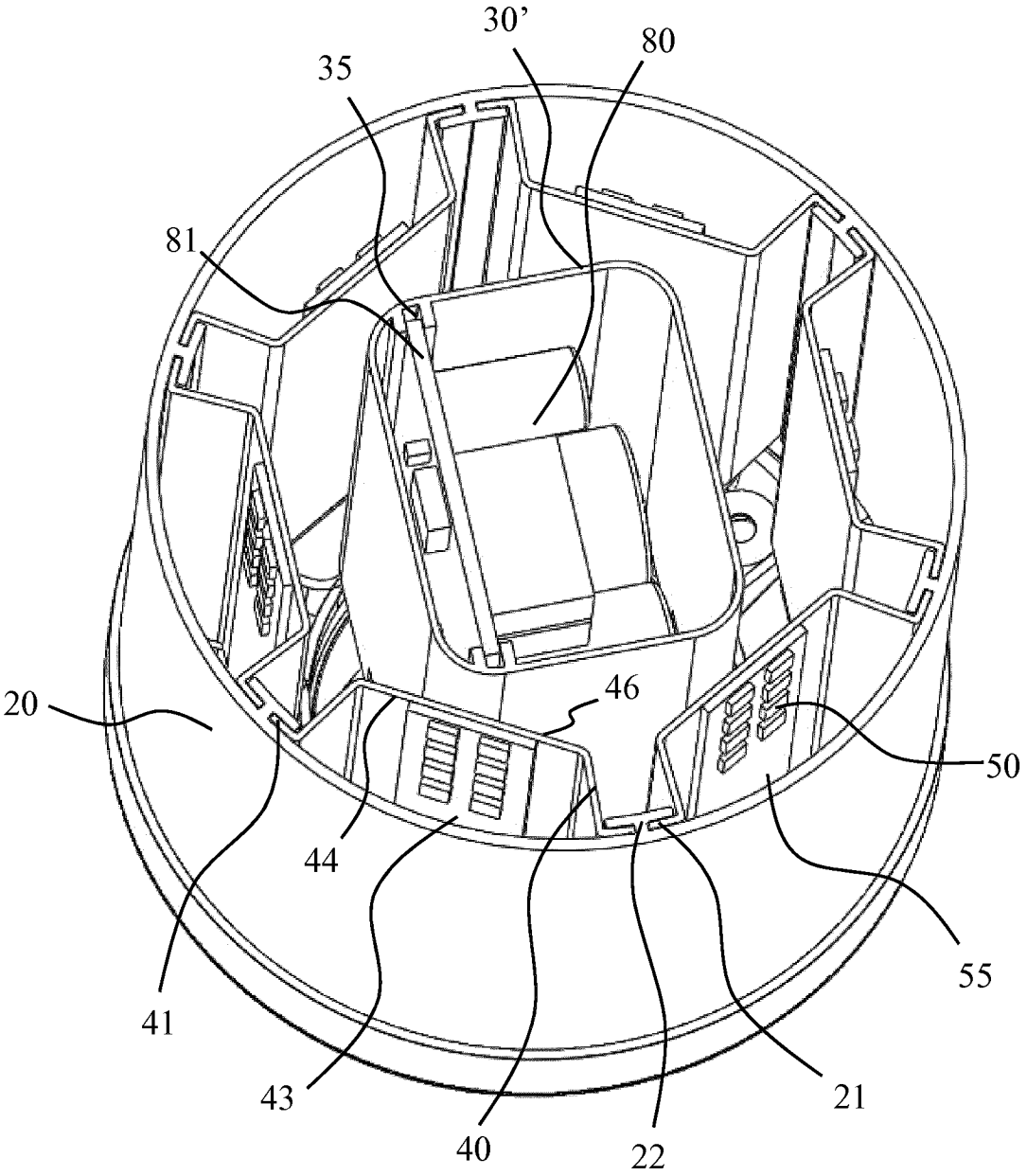
FIG. 3 schematically depicts a cross-sectional view of the solid state lighting lamp of FIG. 1 in a plane perpendicular to its central axis.

FIGS. 1 and 2 schematically depicts a perspective view and FIG. 3 schematically depicts a perspective cross-sectional view of a solid state lighting lamp 10 according to an embodiment of the present invention. The solid state lighting lamp 10 comprises an optical housing 20 extending between a base 60 and a cap 70. FIG. 2 presents the same view of the solid state lighting lamp 10 as FIG. 1, with the exception that in FIG. 2 an elongate portion of the optical housing 20 has been cut away to show the internals of the solid state lighting lamp 10. A central axis 15 of the solid state lighting lamp 10 extends between the base 60 and the cap 70. The base 60 typically comprises an electrical connector (fitting) for connecting the solid state lighting lamp to a mains power supply. In FIG. 1 and FIG. 2, a screw-type (Edison) fitting is shown by way of non-limiting example only at any suitable type of electrical connector 65, e.g. a bayonet fitting, a pin-based (e.g. GU or PAR-type) fitting may be used on the base 60. The optical housing 20 may be affixed to the base 60 and the cap 70 in any suitable manner. For example, as schematically depicted in FIG. 1 and FIG. 2, the base 60 may comprise a lip 61 against which the optical housing 20 is secured, e.g. using an adhesive or fixing member such as screws. Similarly, the cap 70 may be adhered or otherwise affixed, e.g. using screws, against the optical housing 20.

As will be explained in further detail below, the optical housing 20 acts as the light exit window of the solid state lighting lamp 10. The optical housing 20 may be made of any suitable optically transmissive material such as glass or preferably optical grade polymer such as polycarbonate, polyethylene terephthalate or poly (methyl methacrylate), or any other suitable optical grade polymer. The light exit window may be transparent or may be translucent in order to obscure the internals of the solid state lighting lamp 10 from becoming clearly visible.

As can be seen most clearly in FIG. 3, the solid state lighting lamp 10 comprises a plurality of elongate heatsink modules 40 extending along the central axis 15 of the solid state lighting lamp 10. Each elongate heatsink module 40 has a light exit window facing surface 44 (or outward facing surface 44) carrying a plurality of solid state lighting (SSL) elements 50, which may be arranged in one or more linear arrays extending in parallel to the central axis 15. The SSL elements 50 may be any suitable type of SSL elements, e.g. white light of colored light-produced LEDs, which may be controlled in unison, in groups of LEDs or individually. In the most common embodiment, the SSL elements 50 are controlled in unison.

The SSL elements 50 may be mounted directly on the light exit window facing surface 44 of its elongate heatsink module 40 or may be mounted on a carrier 55 such as a PCB or the like, which carrier is mounted onto the module 40 in any suitable manner, e.g. using an adhesive, a fixing arrangement such as a tongue and groove arrangement, fixing members such as screws and so on. The SSL elements 50 in an embodiment do not extend over the full length of the elongate heatsink module 40 in between the cap 70 and the base 60. Rather, the SSL elements 50 are concentrated in a central region of the solid state lighting lamp 10, i.e. facing a central region of the optical housing 20 in order to mimic the luminous distribution (e.g. burner region) of a HPS or HIS lamp in case the solid state lighting lamp 10 is a replacement for such a HPS or HIL lamp.

Each elongate heatsink module 40 is secured against the optical housing 20, i.e. the light exit window 20 such that the light exit window structurally supports the elongate heatsink modules 40. This has the advantage that each elongate heatsink module 40 can be made of a thermally conductive material, e.g. a metal or metal alloy, having a limited thickness to reduce the overall weight of the solid state lighting lamp 10. In a preferred embodiment, the elongate heatsink modules 40 are made of a sheet metal bent in the desired shape for the elongate heatsink modules 40. The elongate heatsink modules 40 may be secured against the light exit window 20 in any suitable manner although preferably the elongate heatsink modules 40 are secured against a light exit window 20 using a tongue and groove-style securing arrangement. For example, each elongate heatsink module 40 may have a pair of outwardly facing and opposing tongues 41 for aligning with grooves 21 on the inner surface of the light exit window or optical housing 20. The grooves 21 may be formed in any suitable manner, for example by a light exit window or optical housing 20 comprising a plurality of protruding portions 22 on its inner surface, which protruding portions define the grooves 21. In FIG. 3 the protruding portions 22 generally have a T-shape to define a pair of grooves 21 on either side of the vertical bar of the T-shape but it should be understood that alternative arrangements are of course equally feasible. One example of such an alternative arrangement is a pair of opposing L-shaped protrusions 22 in between which a single elongate heatsink module 40 is secured in the opposing grooves formed by the L-shaped protrusions. The optical housing or light exit window 20 comprising such protrusions 22 may be made in any suitable manner, e.g. through extrusion, injection moulding, or the like.

In order to further assist the thermal management of the solid state lighting lamp 10, the cap 70 may comprise a plurality of air vents 75 for ventilating the internals of the solid state lighting lamp 10. In particular, air within the solid state lighting lamp 10 typically will be heated by the elongate heatsink modules 40 during operation of the SSL elements 50 as the heat generated by the SSL elements 50 is transferred to the air via the elongate heatsink modules 40. By providing the air vents 75 in the cap 70, such heated air can escape the solid state lighting lamp 10, e.g. through convection, thereby allowing cooler air to enter the solid state lighting lamp 10 and preventing overheating of the lamp. Alternatively, such air circulation within the solid state lighting lamp 10 may be forced air circulation, in which case the solid state lighting lamp 10 may further include a fan (not shown) within the optical housing 20.

In an embodiment, the base 60 may also include air vents (not shown) to generate an air flow substantially in parallel with the central axis 15 through the solid state lighting lamp 10. Such an air flow may run through the solid state lighting lamp 10 along any suitable path. For example, the air flow may run over the SSL elements 50 and/or over the inner surface 46 of the heatsink modules 40 to assist cooling of the solid state lighting lamp 10. It should be understood that the solid state lighting lamp 10 may contain any number of air vents having any suitable shape, in any suitable location to allow such an air flow through the solid state lighting lamp 10.

To further aid the thermal management of the solid state lighting lamp 10, the elongate heatsink modules 40 may be spatially separated from each other such that air can flow in between neighboring elongate heatsink modules 40. This is possible because the elongate heatsink modules 40 not have to be interconnected for their structural support but instead are mounted on the light exit window or optical housing 20, which facilitates the spatial separation of the elongate heatsink modules 40.

The solid state lighting lamp 10 may further comprise a further body 30' within the light exit window or optical housing 20, which further body 30' is typically arranged within a central region inside the solid state lighting lamp 10, i.e. inside the elongate heatsink modules 40. The further body 30' typically houses the driver 80 for the SSL elements 50. The driver 80 may be secured within the further body 30' in any suitable manner. As schematically depicted by way of non-limiting example in FIG. 3, the driver 80 may be mounted on a planar carrier 81, with the further body 30' comprising a pair of opposing grooves 35 into which the planar carrier 81 slots, which can be considered a tongue and groove-style coupling between the carrier 81 of the driver 80 and the grooves 35 of the further body 30'. The further body 30' preferably is made of a lightweight material, e.g. a polymer material or the like, in order to limit the overall weight of the solid state lighting lamp 10 for reasons previously explained.

Figure 4:
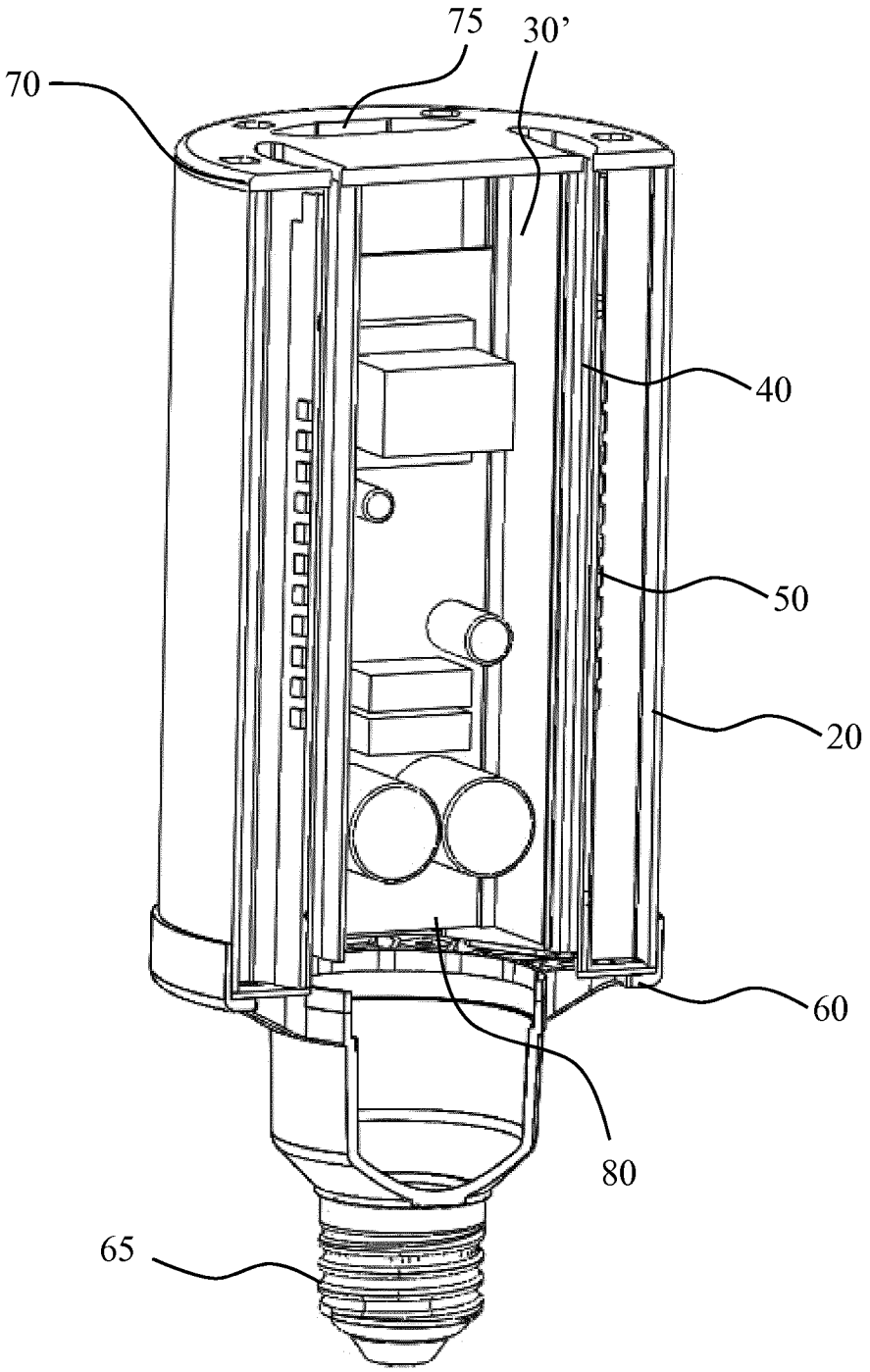
FIG. 4 schematically depicts another cross-sectional view of a solid state lighting lamp of FIG. 1 in a plane along its central axis.

FIG. 4 schematically depicts another cross-sectional view of the solid state lighting lamp 10 of FIG. 1 in which the solid state lighting lamp 10 is further shown to contain the further body 30' housing the driver 80 of the SSL elements 50, with the heat sink modules 40 being arranged in between the further body 30' and the optical housing 20.

Figure 5:
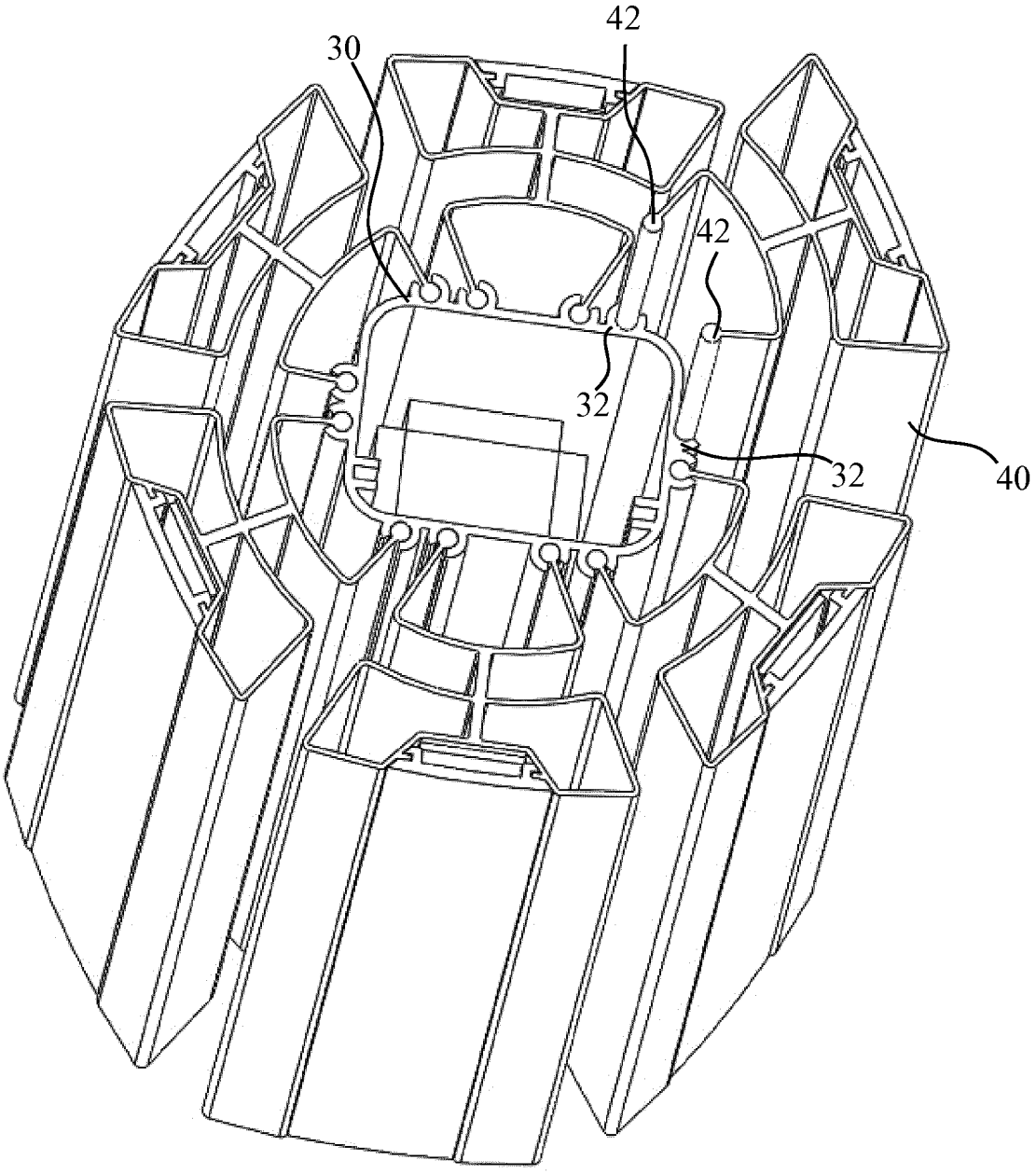
FIG. 5 schematically depicts a perspective view of part of a solid state lighting lamp according to another embodiment.
Figure 6:
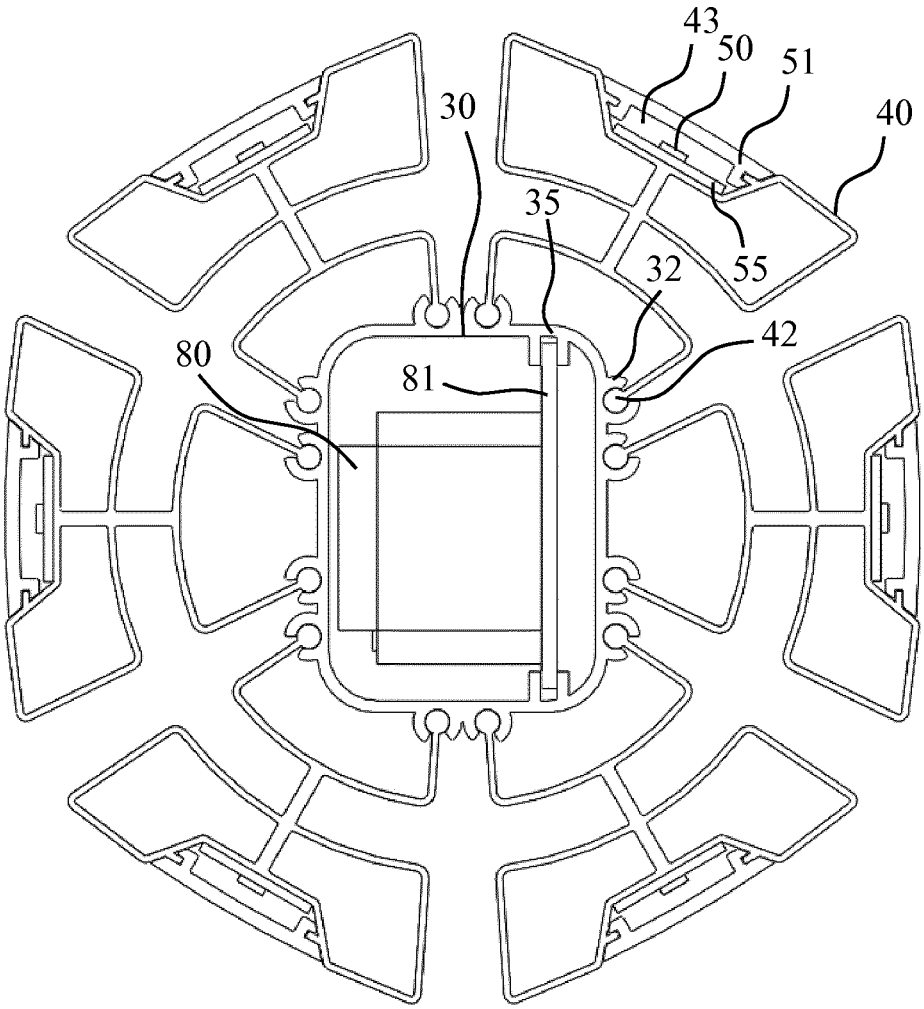
FIG. 6 schematically depicts a top view of part of the cross-section of FIG. 5.

An alternative embodiment of the solid state lighting lamp 10 will now be described in more detail with the aid of FIGS. 5-9. FIG. 5 schematically showing a detail of the solid state lighting lamp 10 according to this embodiment in a perspective view, with FIG. 6 schematically showing this detail in a planar view from above.

Compared to the solid state lighting lamp 10 in a first embodiment, the solid state lighting lamp 10 in this embodiment does not comprise an optical housing 20. Instead, the respective elongate heatsink modules 40 are coupled with the inner body 30 in which the driver 80 of the SSL elements 50 is housed. The body 30, i.e. the driver housing, may be made of any suitable material. The body 30 preferably is made of a lightweight material, e.g. a polymer material or the like to limit the overall weight of the solid state lighting lamp 10.

Preferably, each elongate heatsink module 40 comprises at least a pair of elongate circular pillars or tongues 42 that each slot into a matching elongate circular channel or groove 32 on the body 30. As will be understood by the skilled person and as is clear from for example FIG. 5 and FIG. 6, the channels or grooves 32 are open structures comprising an opening through which a portion of the elongate heating module 40 onto which the circular pillar or tongue 42 is mounted can slide through the groove or channel, as for example can be clearly seen in FIG. 5, in which for the sake of clarity one of the elongate heatsink modules 40 is only partially slotted into its channels or grooves 32 on the body 30, i.e. the housing of the driver 80. In this embodiment, the elongate heatsink modules 40 preferably are made by extrusion, which has the advantage over techniques such as die casting or forging that the heatsink modules can be made more thinly, thereby limiting the overall weight of the solid state lighting lamp 10. For example, the elongate heatsink modules 40 may be extruded aluminium heatsink modules, as aluminium is particularly suitable as a metal in extrusion processes. As before, the driver 80 may be mounted within the body 30 in any suitable manner, for example by a carrier 81 of the driver 80 slotting into opposing grooves 35 in a tongue and groove fashion as previously explained. This is most clearly shown in FIG. 6.

Figure 7:
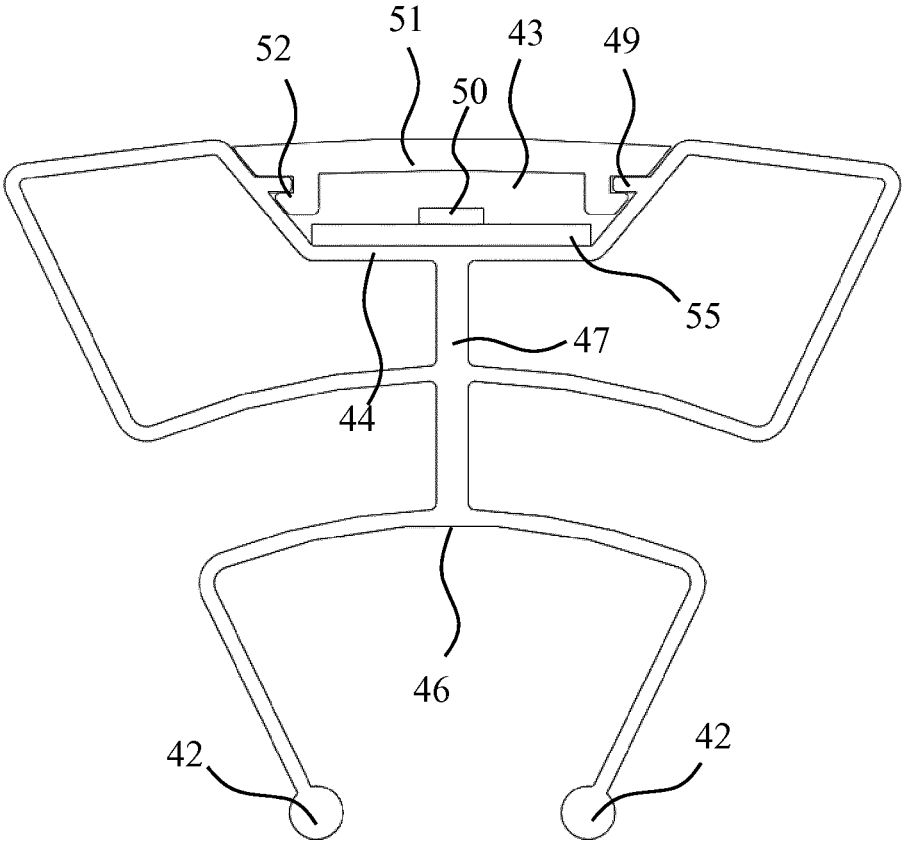
FIG. 7 schematically depicts a heatsink module of a solid state lighting lamp according to the embodiment of FIG. 5.

FIG. 7 schematically depicts a cross-sectional view of such an elongate heatsink module 40 in more detail. Each elongate heatsink module 40 comprises an outward facing surface 44 onto which the SSL elements 50 are mounted either directly or a carrier 55 as previously explained. The outward facing surface 44 typically is shaped such that the elongate heatsink module 40 comprises a recess 43 in which the SSL elements 50 are housed. Each recess 43 is covered by an optical element 51, which optical element 51 typically is made of an optically transmissive material, e.g. an optical grade polymer such as polycarbonate, polyethylene terephthalate or poly (methyl methacrylate), or any other suitable optical grade polymer.

The optical element 51 may act as a cover plate for the SSL elements 50 although in some embodiments the optical element 51 may perform an additional optical function, such as a lens function, a diffuser or scattering function, or the like. The optical element 51 may be secured against the elongate heatsink module 40 in any suitable manner. In an example embodiment as schematically depicted in FIG. 7, the opposing ends 52 of the optical element 51 may define a U-shaped profile with the outward facing surface 44 of the elongate heatsink modules 40 comprising a pair of opposing elongate tongues 49 arranged such that the optical module 51 may be slotted onto the elongate heatsink module 40 by sliding the U-shaped opposing ends 52 over the elongate tongues 49 in a tongue and groove fashion.

Each elongate heating module 40 may further comprise an inward facing surface 46 coupled to the outward facing surface 44 through a support rib 47. The inward facing surface 46 generally may have a U-shape terminating in the elongate pillars or tongues 42 for mating with the body 30 as previously explained. This may serve a number of purposes. Firstly, the separate inward facing surface 46 may be spaced apart from the outward facing surface 44 at any distance by appropriate dimensioning of the support rib 47. In addition, the support rib 47 may improve the structural rigidity of the elongate heatsink module 40 without substantially increasing the overall weight of the elongate heatsink module 40. Furthermore, the increased surface area of the elongate heatsink module 40 by the inclusion of the inward facing surface 46 improves the heat transfer capabilities of the elongate heatsink module 40 such that a larger number of SSL elements 50 may be mounted on each elongate heatsink module 40, thereby increasing the luminous power of the solid state lighting lamp 10. However, it should be understood that the inward facing surface 46 may be omitted from the design of the elongate heatsink module 40, in which case the elongate pillars or tongues 42 may be attached to the main body including the outward facing surface 44 of the elongate heatsink module 40.

Figure 8:
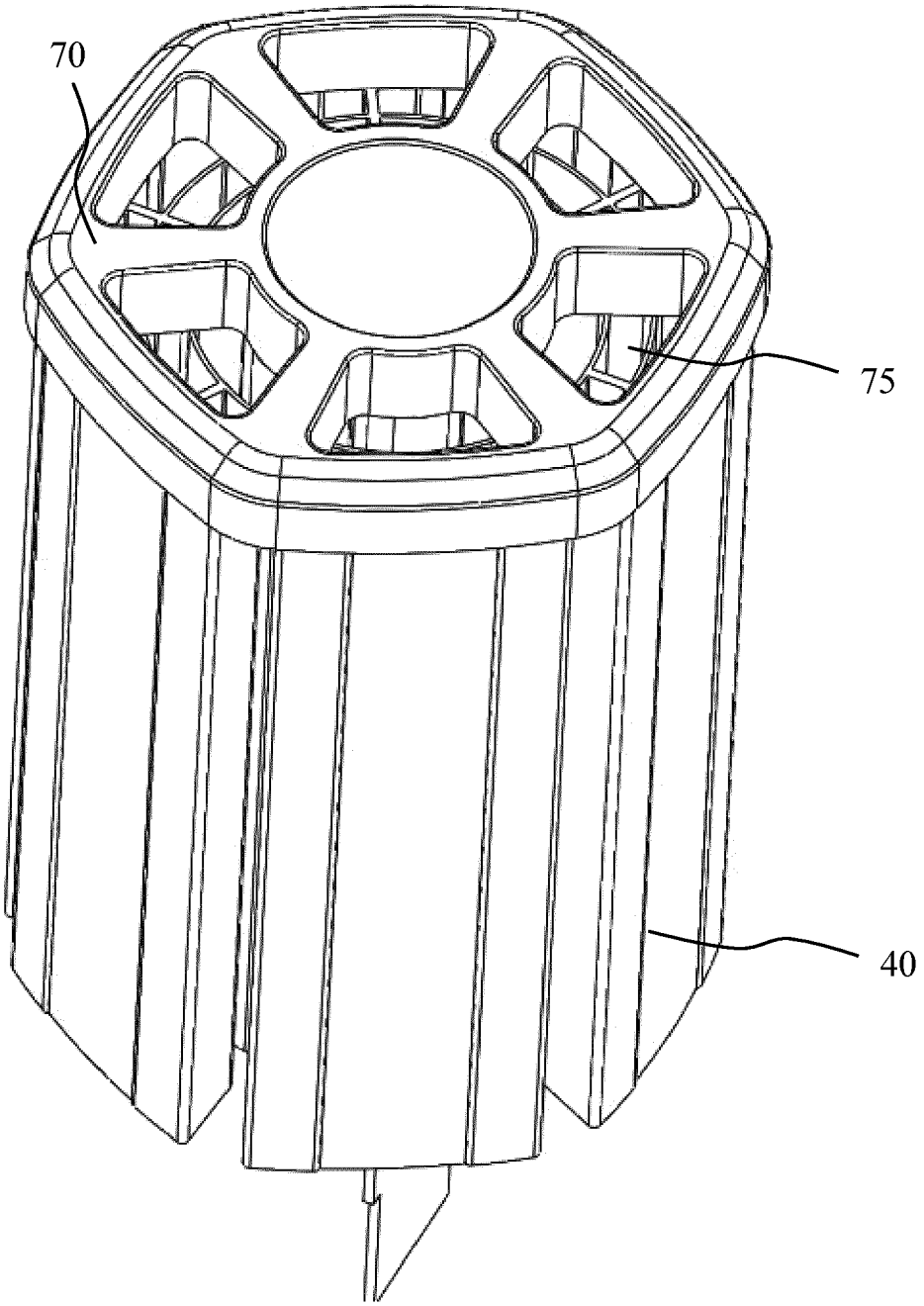
FIG. 8 schematically depicts a perspective view of an upper part of a solid state lighting lamp according to an embodiment of the present invention.
Figure 9:
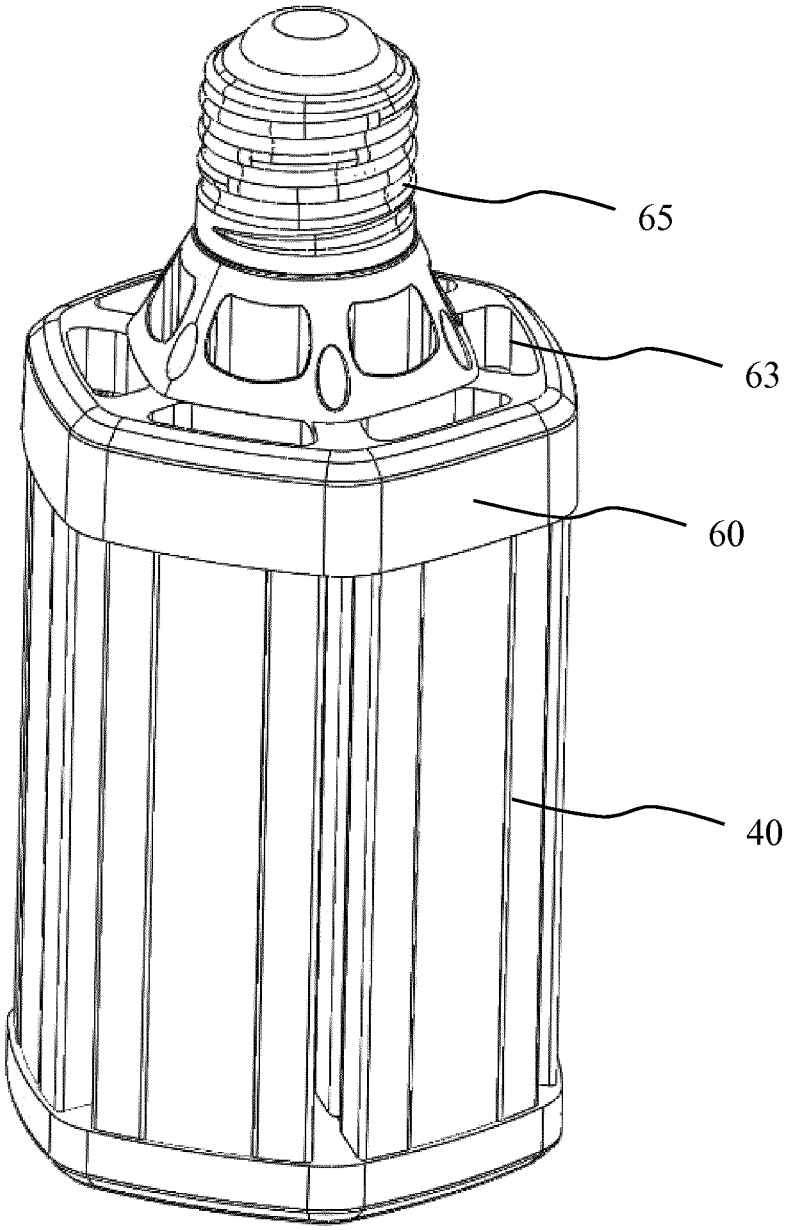
FIG. 9 schematically depicts a perspective view of a lower part of a solid state lighting lamp according to an embodiment of the present invention.

As with the first embodiment, the solid state lighting lamp further comprises a cap 70 as schematically depicted in the perspective view of FIG. 8 and a base 60 including an electrical connector 65 as schematically depicted in the perspective view of FIG. 9, with the elongate heatsink modules 40 extending between the cap 70 and the base 60 as previously explained. As previously explained, the electrical connector 65 may be any suitable type of connector. In an embodiment, the cap 70 comprises air vents 75 to allow hot air to escape from the solid state lighting lamp 10 through convection or by forcing the hot air from the lamp with a fan as previously explained. In addition to the air vents 75 in the cap 70, the solid state lighting lamp 10 may further comprise air vents 63 in the base 60 such that an air flow substantially in parallel with the central axis 15 of the solid state lighting lamp 10 through the air vents 63 in the base 60 and the air vents 75 in the cap 70 may be facilitated in order to transfer the heat collected by the elongate heatsink modules 40 during operation of the SSL elements 50 away from the solid state lighting lamp 10 to improve the thermal management of the solid state lighting lamp 10.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A solid state lighting lamp comprising:

a plurality of heatsink modules each extending in alignment with a central axis of the lamp, each heatsink module having an outward facing surface and an inner surface opposite to the outward facing surface, and carrying a plurality of solid state lighting elements on the outward facing surface;

a body extending in alignment with said central axis and delimiting an inner volume of the lamp, wherein the body is cylindrical and defines a light exit window of the solid state lighting lamp, and each heatsink module is affixed to an inner surface of said body;

a base including an electrical connector; and a cap opposite said base;

wherein the body and the heatsink modules extend between the base and the cap, and each of the cap and the base comprises a plurality of air vents, so as to generate an air flow substantially in parallel with the central axis through the solid state lighting lamp;

wherein each heatsink module is affixed to said body by at least one tongue and groove coupling.

2. The solid state lighting lamp of claim 1, wherein the air flow runs over the solid state lighting elements on the outward facing surface of the heatsink module and over the inner surface of the heatsink modules.

3. The solid state lighting lamp of claim 1, wherein each heat sink module is made of a bent sheet metal.

4. The solid state lighting lamp of any of claim 1, further comprising a further body within the body and a driver for said solid state lighting elements housed within said further body.

5. The solid state lighting lamp of claim 1, wherein each plurality of solid state lighting elements is arranged as at least one linear array of solid state lighting elements aligned with said central axis.

6. The solid state lighting lamp of claim 1, wherein the lamp is a high pressure sodium (HPS) or compact fluorescent lamp (CFL) replacement lamp.

* * * * *